US007740008B2

(12) United States Patent
Brogdon et al.

(10) Patent No.: US 7,740,008 B2
(45) Date of Patent: Jun. 22, 2010

(54) MULTIPLE HEIGHT FLUID MIXER AND METHOD OF USE

(75) Inventors: James W. Brogdon, Daphne, AL (US); Iain V. Ridley, Ann Arbor, MI (US); Scott A. Beatty, Chicago, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 273 days.

(21) Appl. No.: 11/877,315

(22) Filed: Oct. 23, 2007

(65) Prior Publication Data

US 2009/0101123 A1 Apr. 23, 2009

(51) Int. Cl.
*F02B 47/08* (2006.01)
*F02B 47/00* (2006.01)

(52) U.S. Cl. ..... 123/568.15; 123/568.17

(58) Field of Classification Search ..... 123/568.15, 123/568.17, 568.11, 527, 528, 590, 585; 60/605.2
See application file for complete search history.

(56) References Cited

U.S. PATENT DOCUMENTS 5,196,148 A * 3/1993 Nigrelli ..... 261/76
5,207,714 A * 5/1993 Hayashi et al. ..... 123/568.17
5,322,043 A * 6/1994 Shriner et al. ..... 123/295
6,425,382 B1 7/2002 Marthaler et al.
6,427,671 B1 * 8/2002 Holze et al. ..... 123/568.17
6,513,508 B2 * 2/2003 Fischer et al. ..... 123/568.17
6,637,731 B2 * 10/2003 Shane ..... 261/76
6,810,867 B2 * 11/2004 Schmid et al. ..... 123/568.17
2004/0112345 A1 * 6/2004 Bertilsson et al. ..... 123/568.17

* cited by examiner

*Primary Examiner*—Mahmoud Gimie
(74) *Attorney, Agent, or Firm*—Jack D. Nimz; Jeffrey P. Clafa

(57) ABSTRACT

A mixer assembly (204, 603) for mixing intake air from an intake system (124) with exhaust gas from an exhaust gas recirculation system (134) to yield a mixture stream includes an intake air conduit (202, 700) having an inlet (206, 706) fluidly connected to the intake system. The mixer assembly (204, 603) also includes a mixer (200, 600) having an inlet (208, 702) fluidly connected to the exhaust gas recirculation system (134). The mixer (200, 600) is at least partially disposed in the intake air conduit (202, 700) and includes an outer pipe (203, 604) and a dividing portion (217, 602) disposed within the outer pipe. The dividing portion (217, 602) divides a first passage (216, 612) from at least one second passage (218, 608), the first passage having an outlet (216', 612') that is at a first height, and the second passage having an outlet (218', 608') that is at a second height.

15 Claims, 4 Drawing Sheets

MULTIPLE HEIGHT FLUID MIXER AND METHOD OF USE

FIELD OF THE INVENTION

This invention relates to internal combustion engines. More particularly, this invention relates to a fluid mixer assembly for mixing exhaust gas with the intake supply of an internal combustion engine.

BACKGROUND OF THE INVENTION

Most internal combustion engines have some type of emission control device and system. One common type of control system is an exhaust gas recirculation (EGR) system that recirculates exhaust gas from an exhaust system to an intake system of the engine. A high pressure EGR system typically recirculates exhaust gas from upstream of a turbine to downstream of a compressor. Other EGR systems recirculate gas at a low pressure, and are called low-pressure systems. An engine having a high-pressure EGR system has a junction in the air intake system where the EGR gas and the intake air mix to form a mixture. This mixture of exhaust gas and intake air is consumed during engine operation.

Providing each cylinder of an internal combustion engine with a homogeneous mixture of air and exhaust gas is advantageous for operation. A homogeneous mixture promotes efficient operation of the engine because the emission and power output of each cylinder is uniform. The homogeneity of the mixture provided to each cylinder becomes a design parameter of special importance for engines running on a considerable amount of EGR over a wide range of engine operating points.

Many methods devised in the past were intended to improve mixing of exhaust gas with intake air for engines having an EGR system. These methods typically use flow obstructions that increase turbulence in the intake air, the exhaust gas, or the mixture of intake air and exhaust gas, to improve the homogeneity of the mixture supplied to the engine's cylinders. Such methods, although typically fairly effective, have the disadvantage of increasing pressure losses in the intake system of the engine as a result of increased turbulence in the intake air or in the intake mixture. Increased pressure losses in the intake system of an engine leads to decreased engine efficiency and increased fuel consumption.

SUMMARY OF THE INVENTION

A mixer assembly for mixing intake air from an intake system with exhaust gas from an exhaust gas recirculation system to yield a mixture stream includes an intake air conduit having an inlet fluidly connected to the intake system. The mixer assembly also includes a mixer having an inlet fluidly connected to the exhaust gas recirculation system. The mixer is at least partially disposed in the intake air conduit and includes an outer pipe and a dividing portion disposed within the outer pipe. The dividing portion divides a first passage from at least one second passage, the first passage having an outlet that is at a first height, and the second passage having an outlet that is at a second height.

DESCRIPTION OF A PREFERRED EMBODIMENT

The following describes an apparatus for and method of operating an internal combustion engine having an exhaust gas recirculation (EGR) system associated therewith. The EGR system described herein advantageously includes a mixer that mixes exhaust gas with intake air to yield a mixture. The mixture is consumed by the engine by combustion within a plurality of cylinders.

Figure 1:
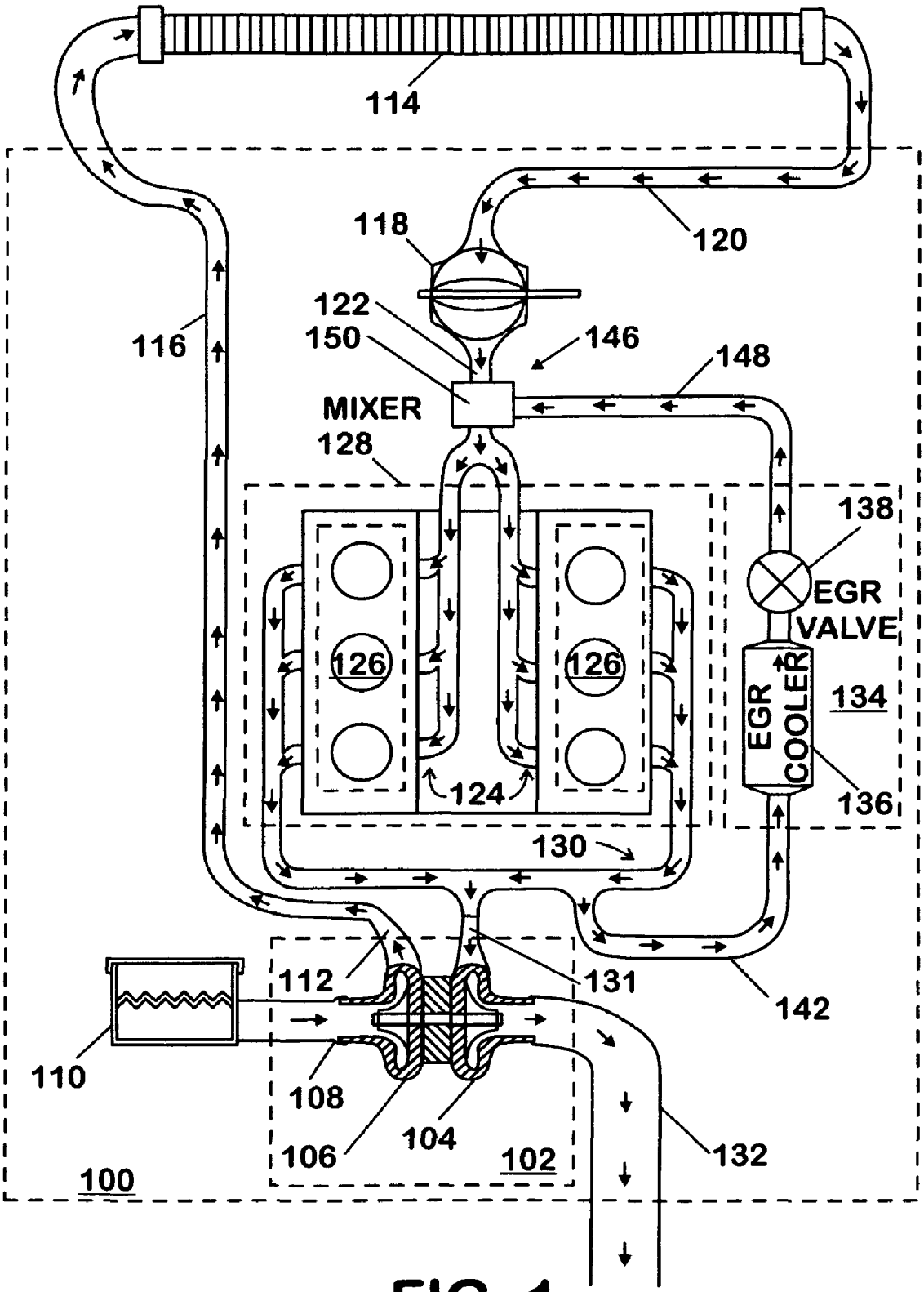
FIG. 1 is a block diagram of an internal combustion engine having a fluid mixer for mixing air with exhaust gas in accordance with the invention.

A block diagram of an engine 100 having an EGR system, as installed in a vehicle, is shown in FIG. 1. The engine 100 includes a turbocharger 102 having a turbine 104 and a compressor 106. The compressor 106 has an air inlet 108 connected to an air cleaner or filter 110, and a charge air outlet 112 connected to a charge air cooler (CAC) 114 through CAC-hot passage 116. The CAC 114 has an outlet connected to an intake throttle valve (ITH) 118 through a CAC-cold passage 120. The ITH 118 is connected to an intake air conduit 122 that fluidly communicates with an intake system of the engine 100, the intake system generally shown as 124. Branches of the intake system 124 are fluidly connected to each of a plurality of cylinders 126 that are included in a crankcase 128 of the engine 100.

Each of the plurality of cylinders 126 of the engine is connected to an exhaust system, generally shown as 130. The exhaust system 130 of the engine 100 is connected to an inlet 131 of the turbine 104. An exhaust pipe 132 is connected to an outlet of the turbine 104. Other components, such as a muffler, catalyst, particulate filter, and so forth, may be connected to the exhaust pipe 132 and are not shown for the sake of simplicity.

The engine 100 has an EGR system, generally shown as 134. The EGR system 134 includes an EGR cooler 136 and an EGR valve 138 connected in a series configuration with each other for passage of exhaust gas therethrough. The EGR cooler 136 fluidly communicates with the exhaust system 130 through an EGR gas supply passage 142. The EGR valve 138 is disposed in line with a cooled-EGR gas passage 148 that is in fluid communication with a junction 146 that is part of the intake air conduit 122. A mixer 150 is located at the junction 146 and fluidly communicates with and connects the cooled-EGR gas passage 148 with the intake air conduit 122.

During operation of the engine 100, air is filtered in the filter 110 and enters the compressor 106 through the inlet 108 where it is compressed. Compressed, or charged, air exits the compressor 106 through the outlet 112 and is cooled in the CAC 114 before passing through the ITH 118. Air from the ITH 118 is mixed with exhaust gas from the cooled-EGR gas passage 148 at the junction 146 through the mixer 150 to yield a mixture. The mixture passes to the intake system 124 by continuing through the intake pipe 122 after the mixer 150 and enters the cylinders 126. While in the cylinders 126, the mixture is additionally mixed with fuel and combusts yielding useful work to the engine 100, heat, and exhaust gas. The exhaust gas from each cylinder 126 following combustion is collected in the exhaust system 130 and routed to the turbine 104. Exhaust gas passing through the turbine 104 yields work that is consumed by the compressor 106.

A portion of the exhaust gas in the exhaust system 130 bypasses the turbine 104 and enters the EGR gas supply passage 142. Exhaust gas entering the passage 142 is exhaust gas that will be recirculated into the intake system 124. The recirculated exhaust gas is cooled in the EGR cooler 136, its amount is metered by the EGR valve 138, and then the gas is routed to the junction 146 for mixing with the charge air exiting the ITH 118 in the mixer 150.

A mixer 200 is shown in FIG. 2 through FIG. 5. The mixer 200 is inserted into an intake air conduit (shown as an elbow) 202 to form a mixer assembly 204. The mixer assembly 204 has an air inlet opening 206, formed in the elbow 202, an EGR gas opening 208, formed in the mixer 200, and a mixer outlet 210 that is formed in the elbow 202. The mixer 200 and elbow 202 together in the mixer assembly 204 perform a similar function to the mixer 150 shown in FIG. 1, that is they both mix air and exhaust gas together. The mixer assembly 204 can also provide functional interfaces for fluid connections to other engine components.

The assembly 204 is shown to include the elbow 202 to illustrate one configuration where the mixer 200 may be most advantageous to the operation of an engine. The elbow 202 includes a 90-degree radius that typically would hinder formation of a homogeneous mixture. Use of the mixer 200 advantageously provides a homogeneous mixture at the outlet 210 of air entering the assembly 204 through the air inlet opening 206 with exhaust gas entering the mixer 200 through the EGR gas opening 208.

The mixer 200 includes an inlet port 212 that forms the EGR gas opening 208 and that protrudes from the elbow 202. The inlet port 212 is shown in a configuration that allows a hose (not shown) carrying exhaust gas to be connected thereto, but other configurations and modes of providing exhaust gas to a mixer are contemplated. The elbow 202 forms a collar 214 that is arranged to accommodate the inlet port 212 portion of the mixer 200 therein, and provide support and sealing there-between. A dividing portion 217 of the mixer 200 is generally "teardrop"-shaped, with a cornered end, however other configurations are contemplated. The "teardrop" or wingfoil-inspired shape results in less drag and less pressure drop for the air traveling around the mixer 200. The dividing portion 217 is disposed in an outer pipe 203 and defines a central passage 216. The dividing portion 217 also subdivides a first side-passage 218 and a second side-passage 220 on either side of the central passage 216 within the outer pipe 203. The outlets 216', 218' and 220' of the central passage 216, the first side-passage 218, and the second side-passage 220, respectively, are located inside an internal passage volume 222 of the elbow 202. The outlets 216', 218' and 220' are inclined such that the higher end of the outlet is nearer the inlet 206 of the intake air conduit 202 than a lower end of the outlet.

Figure 2:
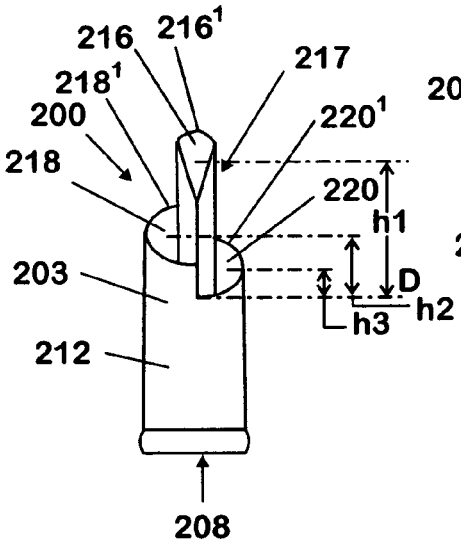
FIG. 2 is a rear view of the mixer in accordance with the invention.
Figure 3:
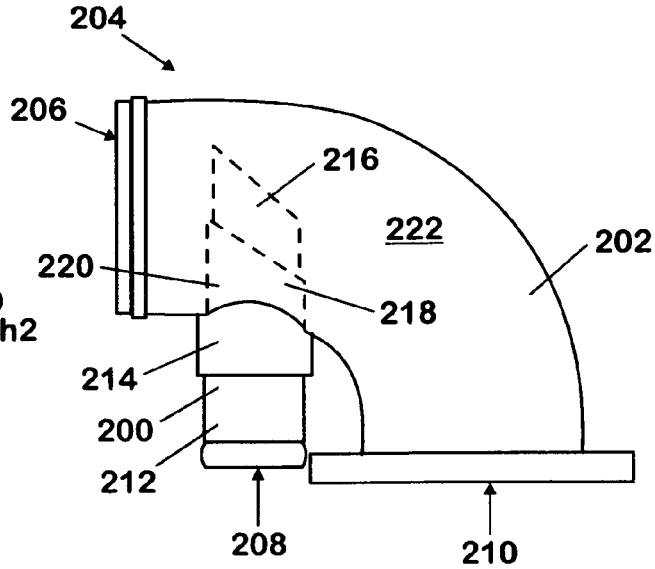
FIG. 3 is a side view of the mixer assembly in accordance with the invention.
Figure 4:
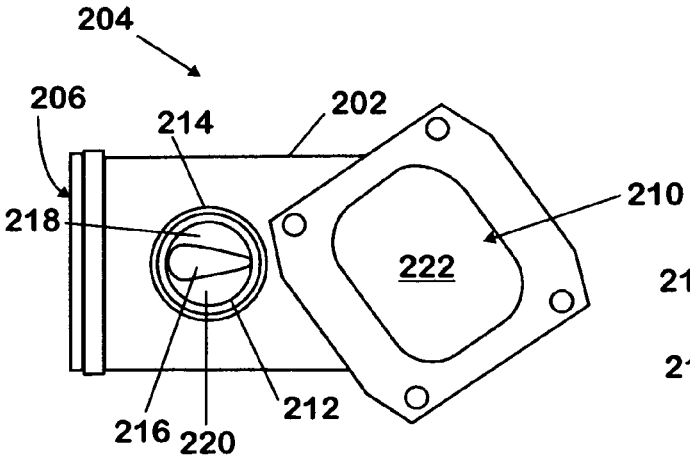
FIG. 4 is a bottom view of the mixer assembly in accordance with the invention.
Figure 5:
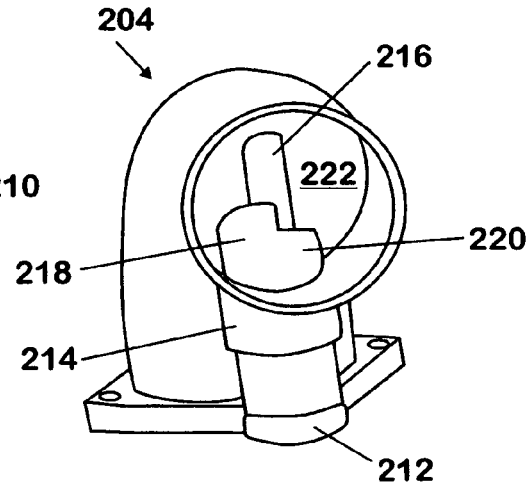
FIG. 5 is a front perspective view of the mixer assembly in accordance with the invention.

Openings through which exhaust gas may exit the mixer 200 in each of the central, first-side, and second-side passages 216, 218 and 220 are advantageously positioned at different relative heights within the internal passage 222 of the elbow 202. The central passage outlet 216' has an average height h1 measured from a datum D located at the lowest point of the openings to the passages 216, 218, 220, as shown in FIG. 2. The average height of the outlet 218' is a height h2 from the point where hi is measured from, with h2 being less than h1. Similarly, the outlet 220' has an average height h3 measured from the same point h1 and h2 are measured from, with h3 being less than h1 and h2. Further, the maximum height of the outlet 216' is greater than the maximum height of the outlet 218', which is greater than the maximum height of the outlet 220'.

Alternatively, the outlets of the central passage 216, the first side-passage 218, and the second side-passage 220 can be configured and arranged in different locations within the internal passage volume 222. Further, the number, location and heights of the outlets within the conduit 202 can vary.

Figure 6:
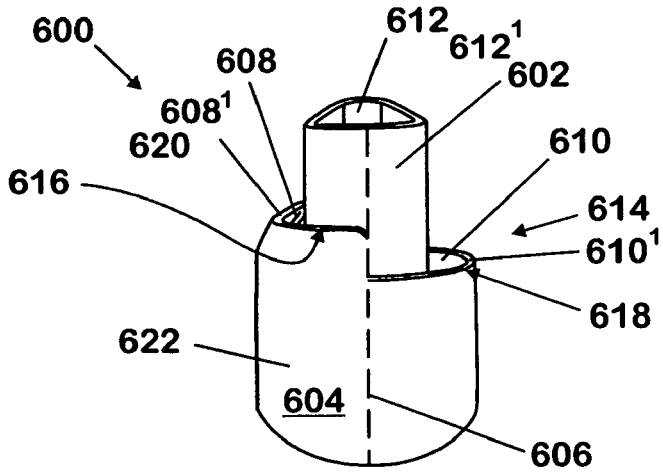
FIG. 6 is a top perspective view of an alternate embodiment of mixer in accordance with the invention.
Figure 7:
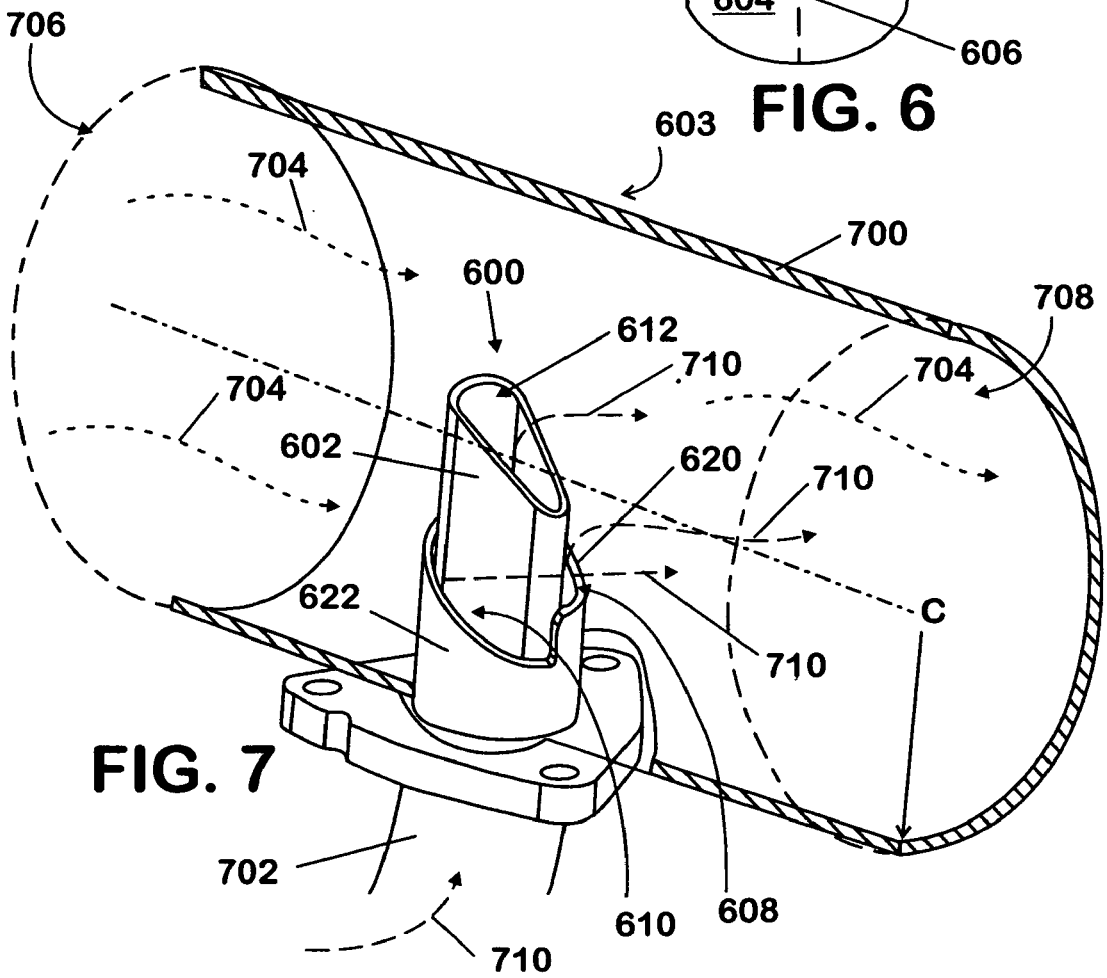
FIG. 7 is a cut-away view of a mixer assembly in accordance with the invention.

A second embodiment of a mixer 600 disposed in an intake air conduit 700 to form a mixer assembly 603 is shown in FIG. 6 through FIG. 7. The dividing portion 602 includes a central portion 602. The dividing portion 602 has a "teardrop" or airfoil cross-sectional shape. The dividing portion 602 is located within an outer pipe 604. The dividing portion 602 may be in contact with the outer pipe 604 along two diametrically opposite lines of contact 606 (only one visible), thus creating a first passage 608 and a second passage 610 between the dividing portion 602 and the outer pipe 604. A third passage 612 exists within the dividing portion 602. In this manner, a flow area of the outer pipe 604 is segmented into three portions, the first passage 608, the second passage 610, and the third passage 612. Similar to the first embodiment, the average height of the outlets of the first passage 608, the second passage 610 and the third passage 612 are different from each other. That is, the outlets 608', 610' and 612' of the first through third passages 608, 610, 612 are staggered in height.

The outer pipe 604 is cut to a length that is less than a length of the dividing portion 602 such that a segment of the dividing portion 602 protrudes past an end 614 of the outer pipe 604. The end 614 of the outer pipe 604 is stepped to create a first edge 616 for the first passage 608 that is different than a second edge 618 for the second passage 610. Each of the first and second edges 616 and 618 is substantially semi-circular and positioned along different lengths, or alternatively heights, along a length of the outer pipe 604. In the embodiment shown, each of the first and second edges 616 and 618 is cut at an angle with respect to a circular cross-section of the circular outer pipe 604. Moreover, the mixer 600 has a directional feature to direct flow passing therethrough, in that a portion 620 of a wall 622 of the outer pipe 604 is inclined inward along a region surrounding the first passage 608 such that a portion of a fluid flowing through the first passage 608 is directed toward the dividing portion 602.

A partial cross-sectional view of the mixing portion 600 as installed into an intake air conduit 700 of an internal combustion engine is shown in FIG. 7. The intake air conduit 700 has a circular cross section with a radius r and a centerline C, however other shapes are contemplated. The mixing portion 600 shown in this view also includes an EGR gas feed pipe 702. The EGR gas feed pipe 702 is connected to a source of exhaust gas (not shown) that may be, for example, an outlet port of an EGR valve or cooler (neither shown).

During operation of an engine, air passes through the intake air conduit 700. The flow of air in the intake air conduit 700 is denoted by dotted-lined-arrows, generally at 704. The air flow 704 enters the segment of the intake air conduit 700 at an inlet cross section 706, passes over and around the mixer 600, and exits the segment of the intake air conduit 700 at an outlet cross section 708. At times during operation, a flow of exhaust gas reaches the mixer 600 through the EGR gas feed pipe 702. The flow of exhaust gas is denoted by dashed-linearrows, generally at 710. The exhaust flow 710 in the EGR gas feed pipe 702 is advantageously split into three sub-streams, with each sub-stream exiting the mixer 600 through the first passage 608, the second passage 610, and the third passage 612. Even though the three sub-streams are described together, a flow rate of each depends on the outlet opening size of each of the first passage 608, the second passage 610, and the third passage 612, which do not need to be equal. Therefore, each sub-stream exiting each flow passage can have a different flow rate than another stream.

Figure 8:
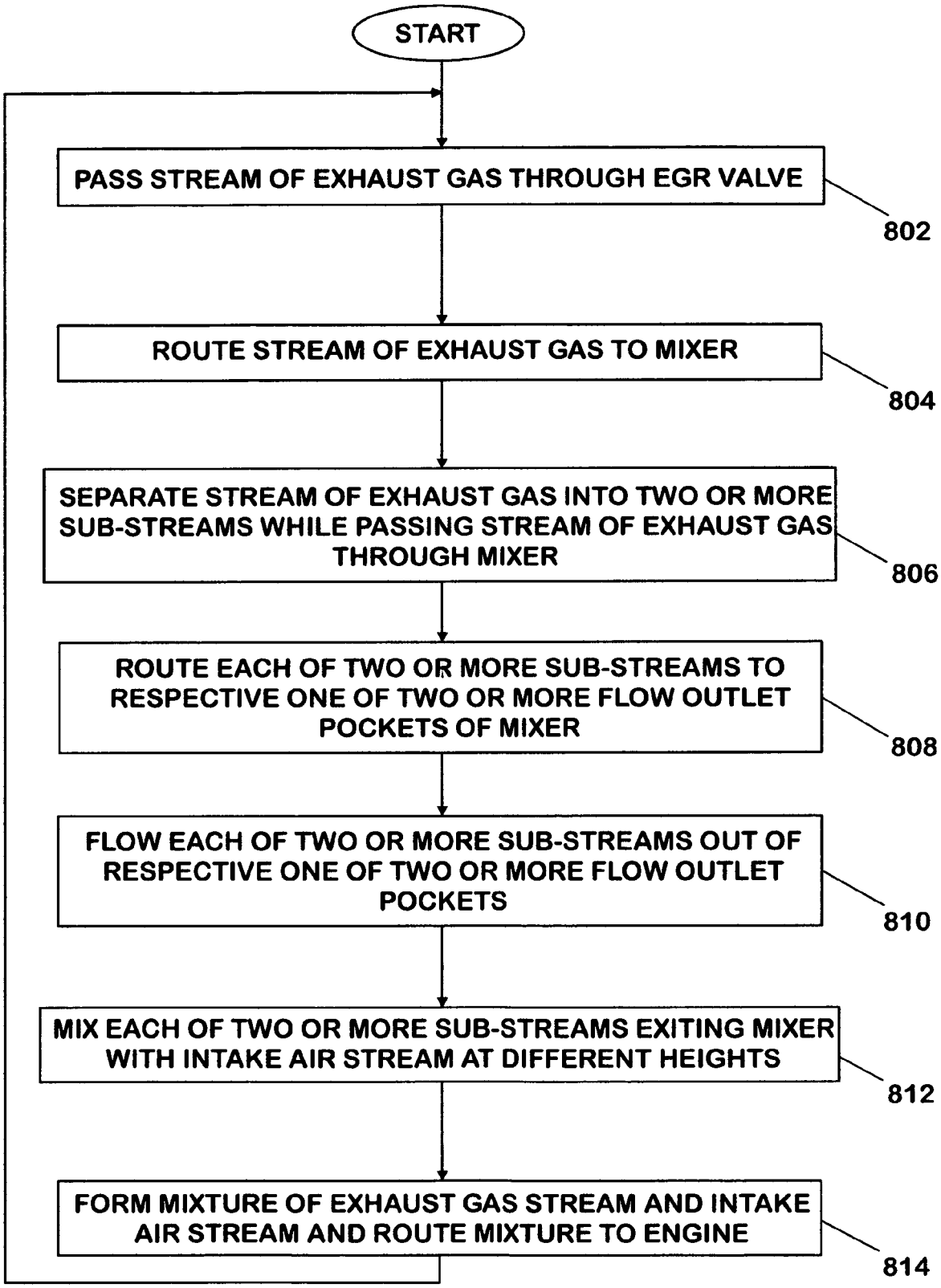
FIG. 8 is a flowchart for a method of mixing air and exhaust gas for the internal combustion engine in accordance with the invention.

A flowchart for a method of mixing a flow of air with a flow of exhaust gas for an EGR system associated with an internal combustion engine is shown in FIG. 8. A stream of exhaust gas from a high pressure or a low pressure location of an exhaust system of an engine passes through an EGR valve at step 802. The stream of exhaust gas may be at a high or low pressure, and may optionally be cooled. The stream of exhaust gas is routed to a mixer assembly at step 804. While passing through the mixer assembly, the stream of exhaust gas is separated into two or more sub-streams at step 806. Each of the two or more sub-streams of exhaust gas is routed to one of two or more flow outlet passages at step 808. Each of the two or more sub-streams exits the mixer through its respective flow outlet passage at step 810. Each of the two or more sub-streams exiting the mixer is mixed at different heights with a flow of air passing over and around the mixer in an intake air conduit at step 812. A mixture formed by the flow of intake air and the two or more sub-streams of exhaust gas is routed to an internal combustion engine at step 814, and the process is repeated as necessary for the operation of the internal combustion engine.

The mixer assemblies 204, 603 mix the intake air with the exhaust gas under a variety of flow conditions, while keeping the pressure losses inside the conduit 202, 700 to a minimum. The exhaust gas is distributed inside the conduit 202, 700 by subdividing the flow with dividing portions into multiple passages, each passage having an outlet with a different range of height than other passages. Advantageously, by having three different heights at which the new fluid is introduced into the main air/fluid, there is increased control of the vertical distribution (thus better mixing). Also, the mixer assemblies 204, 603 can mix effectively over a wider range of fluid inlet velocities because the three release heights make it easier for exhaust fluid with low momentum to reach any desired height before it is released into the main air/fluid. Through careful selection of the cross-sectional areas of the passages, the velocities of the streams of exhaust fluid can be adjusted for maximizing distribution (and resultant mixing) and minimizing the pressure drop.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A mixer assembly for mixing intake air from an intake system with exhaust gas from an exhaust gas recirculation system to yield a mixture stream, comprising:

an intake air conduit having an inlet fluidly connected to the intake system;

a mixer having an inlet fluidly connected to the exhaust gas recirculation system, the mixer being at least partially disposed in the intake air conduit, the mixer comprising:

an outer pipe; and a dividing portion disposed within the outer pipe, the dividing portion providing a first exhaust gas passage and defining a second exhaust gas passage and a third exhaust gas passage on either side of the dividing portion, the first exhaust gas passage having an outlet at a first height within the intake air conduit; the second exhaust gas passage having an outlet at a second height within the intake air conduit, and the third exhaust gas passage having an outlet at a third height within the intake air conduit.

2. The mixer assembly of claim 1 wherein the dividing portion defines a first passage disposed generally centrally in the mixer, and the dividing portion contacts the outer pipe at two locations to define the second passage and a third passage with an outlet.

3. The mixer assembly of claim 2 wherein the first outlet, the second outlet, and the third outlet are disposed at different heights along the length of the mixer.

4. The mixer assembly of claim 1 wherein the first and second outlets are inclined such that a higher end of the outlet is nearer the inlet of the intake air conduit than a lower end of the outlet.

5. The mixer assembly of claim 1 wherein the intake air conduit has a generally 90-degree radius.

6. The mixer assembly of claim 1 wherein a portion of the outer pipe is inclined inward towards the dividing portion along a region surrounding the first passage such that a portion of the exhaust gas flowing through the outer pipe is directed toward the dividing portion.

7. A mixer for mixing a first fluid stream with a second fluid stream to yield a mixture stream, comprising:

an outer pipe having a length and a first end;

a dividing portion disposed within the outer pipe and protruding past the first end of the outer pipe, wherein the dividing portion is connected to the outer pipe along two diametrically opposite lines of contact, wherein a flow area of the outer pipe is segmented into a first passage defined by the dividing portion, a second passage is formed between the dividing portion and the outer pipe on a first side of the first passage, and a third passage is formed between the dividing portion and the outer pipe on a second side of the first passage.

8. The mixer of claim 7 wherein the dividing portion has an airfoil-shaped cross section.

9. The mixer of claim 7 wherein the first passage has a first outlet, and the second passage has a second outlet, wherein the first outlet and the second outlet have a different maximum height.

10. The mixer of claim 9 wherein the first and second outlets are inclined with respect to the length of the outer pipe.

11. The mixer of claim 7 wherein a portion of the outer pipe is inclined inward towards the dividing portion along a region surrounding the second passage such that a portion of the exhaust gas flowing through the second passage is directed toward the dividing portion.

12. The mixer of claim 7 wherein the first passage has a first outlet, the second passage has a second outlet, and the third passage has a third outlet, wherein the first outlet has a maximum height that is higher than a maximum height of the second outlet, and the second outlet has a maximum height that is higher than a maximum height of the third outlet.

13. A method for mixing intake air from an intake system with exhaust gas from an exhaust gas recirculation system to yield a mixture flow, comprising the steps of:

passing the intake air through an intake conduit;

disposing a mixer in the intake conduit generally perpendicular to the flow of intake air in the intake conduit, wherein the mixer has at least two passages, at least one passage having an outlet at a different height than another passage;

passing the exhaust gas through the mixer;

separating the flow of exhaust gas into the at least two passages;

distributing the exhaust gas out of the outlets of the at least two passages at different heights; and mixing the exhaust gas from the at least two passages with the intake air inside the intake conduit to form the mixture flow.

14. The method of claim 13, further comprising the step of diverting the intake air around the mixer disposed in the conduit.

15. The method of claim 13, wherein said mixer comprises a central passage and at least one side-passage, and further comprising the step of deflecting at least a portion of the flow through the at least one side-passage towards the central portion.

* * * * *